US009441899B2

(12) United States Patent
Micklethwaite

(10) Patent No.: US 9,441,899 B2
(45) Date of Patent: Sep. 13, 2016

(54) RIFLE/SHOTGUN COMBINATION AND CONVERSION METHOD

(71) Applicant: Russell Micklethwaite, Chandler, AZ (US)

(72) Inventor: Russell Micklethwaite, Chandler, AZ (US)

( * ) Notice: Subject to any disclaimer, the term of this patent is extended or adjusted under 35 U.S.C. 154(b) by 113 days.

(21) Appl. No.: 14/276,568

(22) Filed: May 13, 2014

(65) Prior Publication Data

US 2015/0176938 A1 Jun. 25, 2015

Related U.S. Application Data

(60) Provisional application No. 61/822,780, filed on May 13, 2013.

(51) Int. Cl.
*F41A 19/18* (2006.01)
*F41A 11/02* (2006.01)
*F41A 19/44* (2006.01)

(52) U.S. Cl.
CPC ..... *F41A 19/18* (2013.01); *F41A 11/02* (2013.01); *F41A 19/44* (2013.01)

(58) Field of Classification Search
CPC ..... F41F 1/08; F41A 19/00; F41A 19/06; F41A 19/09; F41A 19/18; F41A 19/20
USPC ..... 89/126, 127; 42/69.01, 69.02, 69.03
See application file for complete search history.

(56) References Cited

U.S. PATENT DOCUMENTS 2,935,915 A * 5/1960 Kenneth ..... F41A 5/28 89/126
3,442,173 A * 5/1969 Muller ..... F41A 19/21 42/105
3,715,954 A * 2/1973 Rude, Jr. ..... F41A 19/02 89/127
4,041,633 A * 8/1977 Scrufari ..... F41C 3/14 42/59
4,357,774 A * 11/1982 Badger ..... F41A 21/06 42/59
4,494,332 A * 1/1985 Matievich ..... F41A 21/12 42/59
4,669,211 A * 6/1987 Russell ..... F41C 9/08 42/51
4,867,039 A * 9/1989 Dobbins ..... F41A 9/35 42/18
4,882,973 A * 11/1989 Piscetta ..... F41A 9/35 89/1.41
4,967,642 A * 11/1990 Mihaita ..... F41A 3/72 89/126
5,146,705 A * 9/1992 Martin ..... F41C 27/06 42/70.06
5,341,587 A * 8/1994 Phillips, Jr. ..... F41A 15/02 42/68
6,250,194 B1 * 6/2001 Brandl ..... F41A 19/18 42/71.01
8,393,107 B2 * 3/2013 Brown ..... F41C 7/00 42/105
8,839,709 B1 * 9/2014 Crye ..... F41A 9/74 89/157
2006/0254110 A1 * 11/2006 Occhionero ..... F41A 19/09 42/70.07
2014/0000143 A1 * 1/2014 Safewright, Jr. ..... F41A 9/71 42/49.02

* cited by examiner

*Primary Examiner* — Jonathan C Weber
(74) *Attorney, Agent, or Firm* — Robert A. Parsons; Michael W. Goltry; Parsons & Goltry

(57) ABSTRACT

A rifle/shotgun combination firearm includes a shotgun receiver portion and a lower receiver portion extending rearwardly from the shotgun receiver portion. A rifle trigger assembly is carried in the lower receiver portion and actuated by a rifle trigger coupled thereto. A shotgun trigger assembly is carried by the shotgun receiver portion and actuated by a shotgun trigger pivotally carried on a transversely oriented pivot pin in the lower receiver portion. A shotgun trigger transfer bar couples the shotgun trigger assembly to the shotgun trigger.

5 Claims, 3 Drawing Sheets

| ITEM NO. | PART NUMBER | DESCRIPTION | QTY |
|---|---|---|---|
| 6 | AR Hammer | 597040 | 1 |
| 7 | AR Trigger | 597030 | 1 |
| 8 | AR Trigger Sear | 597025 | 1 |
| 9 | AR Chrk Link | 597005 | 1 |
| 10 | AR Disconnector | 597035 | 1 |
| 13 | AR Safety | 155164 | 1 |
| 24 | Shot Trigger | 579125 | 1 |
| 25 | Shot Trigger Ass. | | 1 |
| 28 | Shot Sear | 875032 | 1 |
| 29 | Shot Trigger Cam | 579105 | 1 |
| 31 | Shot Connector Right | 875015 | 1 |
| 32 | Shot Connector Left | 875014 | 1 |
| 33 | Shot Trigger Transfer Bar | 579115 | 1 |
| 34 | Shot Hammer | 875033 | 1 |
| 35 | Shot Safety | 579130 | 1 |
| 45 | AR Chrk Link Pin | 579010 | 1 |
| 46 | AR Trigger Sear Pin | 579026 | 1 |
| 47 | AR Hammer Pivot Tube | 579031-41 | 2 |

Trigger Group Working Parts 2

RIFLE/SHOTGUN COMBINATION AND CONVERSION METHOD

FIELD OF THE INVENTION

This invention relates to firearms.

More particularly, the present invention relates to rifle/shotgun combination firearms.

BACKGROUND OF THE INVENTION

In the field of firearms, different firearms serve different purposes. Rifles employ single projectiles and tend to be accurate at greater ranges and for selective targeting. Other firearms such as shotguns, can employ multiple projectiles and tend to be used at shorter ranges. These types of firearms are much less selective, and are often used to control groups and multiple targets at one time. This latter type of firearm can also provide more options, including non-lethal projectiles, breaching charges and the like. During military or law enforcement actions, both types of weapons can be necessary. Providing both firearms can include a separate individual carrying one or the other firearm, or a single individual carrying both. In the first instance, more individuals, having less effectiveness, is costly and inefficient. In the second instance, a single individual carrying both types of firearm can be cumbersome and inconvenient.

Attempts have been made to combine firearms, such as a grenade launcher on an M16 rifle for military use. The biggest problems with these combinations, is that the operating mechanisms, and therefore, the trigger assemblies are in different locations. This requires the user to re-grip the firearm in different locations to operate the different firearms. This can be problematic if action is needed quickly.

It would be highly advantageous, therefore, to remedy the foregoing and other deficiencies inherent in the prior art.

An object of the present invention is to provide a rifle/shotgun combination firearm.

Another object of the present invention is to provide a rifle/shotgun combination firearm wherein the triggers are positioned adjacent one another for use without re-gripping the firearm.

Yet another object of the present invention is to provide a rifle/shotgun combination firearm employing many components of the base firearms.

SUMMARY OF THE INVENTION

Briefly, to achieve the desired objects and advantages of the instant invention provided is a rifle/shotgun combination firearm including a receiver having a forward end and a rearward end. The receiver includes a shotgun receiver portion adjacent the forward end and a lower receiver portion adjacent the rearward end. A shotgun barrel and a shotgun magazine tube are coupled to the shotgun receiver portion and extend forwardly from the forward end thereof. An upper receiver is coupled to the lower receiver portion. A rifle barrel is coupled to and extends forwardly from the upper receiver. A trigger mechanism is carried by the receiver. The trigger mechanism includes a rifle trigger assembly carried in the lower receiver portion and actuated by a rifle trigger coupled thereto. The rifle trigger has a finger grip extending below the lower receiver portion. A shotgun trigger assembly is carried by the shotgun receiver portion and actuated by a shotgun trigger pivotally carried on a transversely oriented pivot pin in the lower receiver portion. The shotgun trigger has a finger grip extending below the lower receiver portion adjacent the rifle trigger. A shotgun trigger transfer bar couples the shotgun trigger assembly to the shotgun trigger.

In a further aspect of the rifle/shotgun combination firearm, the rifle trigger assembly further includes a sear member pivotally mounted within the lower receiver for movement between an engaged position and a disengaged position and a link member pivotally mounted within the lower receiver and pivotally coupled between the trigger and the sear member so as to provide a space between the shotgun trigger and the rifle trigger.

Also provided is a rifle hammer mounted on the pivot pin in the lower receiver portion for rotation between a forward position and a rearward position. The pivot pin is the same pin carrying the shotgun trigger.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
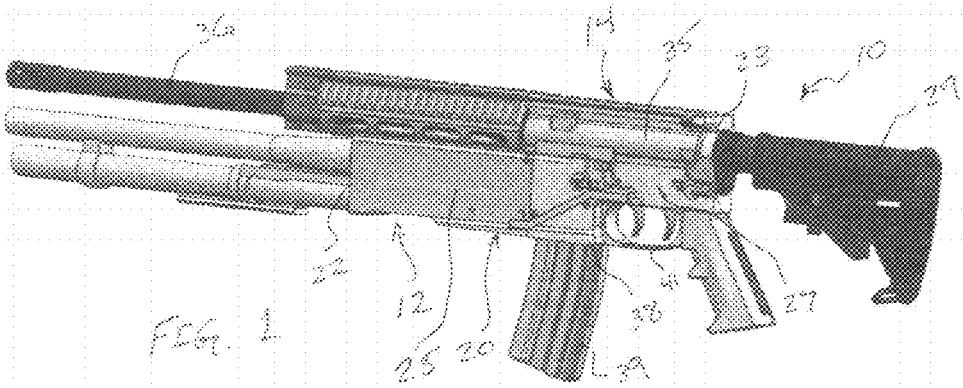
FIG. 1 is a left perspective view of a rifle/shotgun combination according to the present invention.
Figure 2:
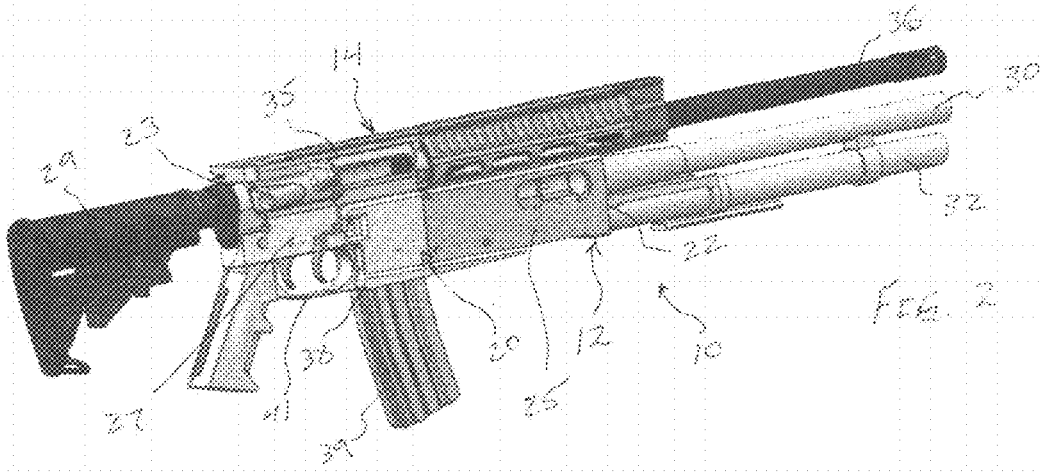
FIG. 2 is a right perspective view of a rifle/shotgun combination of FIG. 1.

Turning now to the drawings in which like reference characters indicate corresponding elements throughout the several views, attention is directed to FIGS. 1 and 2 which illustrate a rifle/shotgun combination firearm, generally designated 10. Firearm 10 is a combination of a shotgun assembly 12 and a rifle assembly 14 positioned in a vertically adjacent orientation. In the preferred embodiment, rifle assembly 14 is preferably a semi-automatic rifle of the AR-15 type, a trademark of Colt Defense LLC. Variants of the AR-15 firearm are independently made, modified and sold under various names by multiple manufacturers. These types of firearms are well known and often used by military, paramilitary and law enforcement organizations. While semi-automatic firearms are preferred, other versions, such as fully automatic, can also be utilized. Additionally, rifle assembly 14 can be of different calibers, including the AR-10 type, a trademark of Armalite Inc., and LAR-8 a trademark of Rock River Arms. Variants of the AR-10 and LAR-8 firearms are independently made, modified and sold under various names by multiple manufacturers. Shotgun assembly 12 is substantially any semi-automatic or pump action shotgun, but preferably includes parts from a Remington 870, as that is a type used by many law enforcement organizations. Firearm 10 is intended to incorporate and combine a majority of parts from an AR-15 type rifle with a shotgun such as the Remington 870 shotgun, the types found in many law enforcement organizations, although other rifles and shotguns can be employed.

Figure 3:
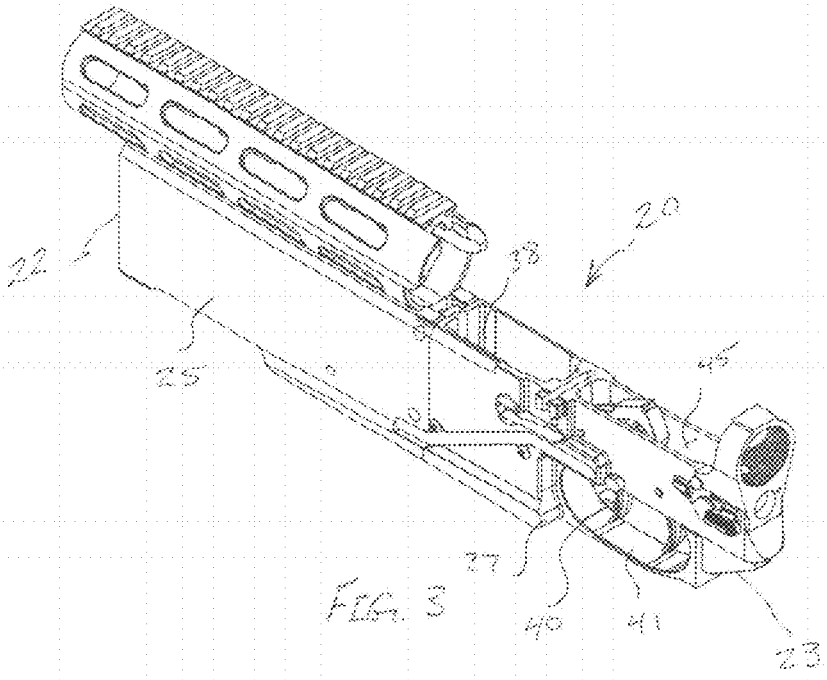
FIG. 3 is a perspective side view of the combination receiver of the present invention.
Figure 4:
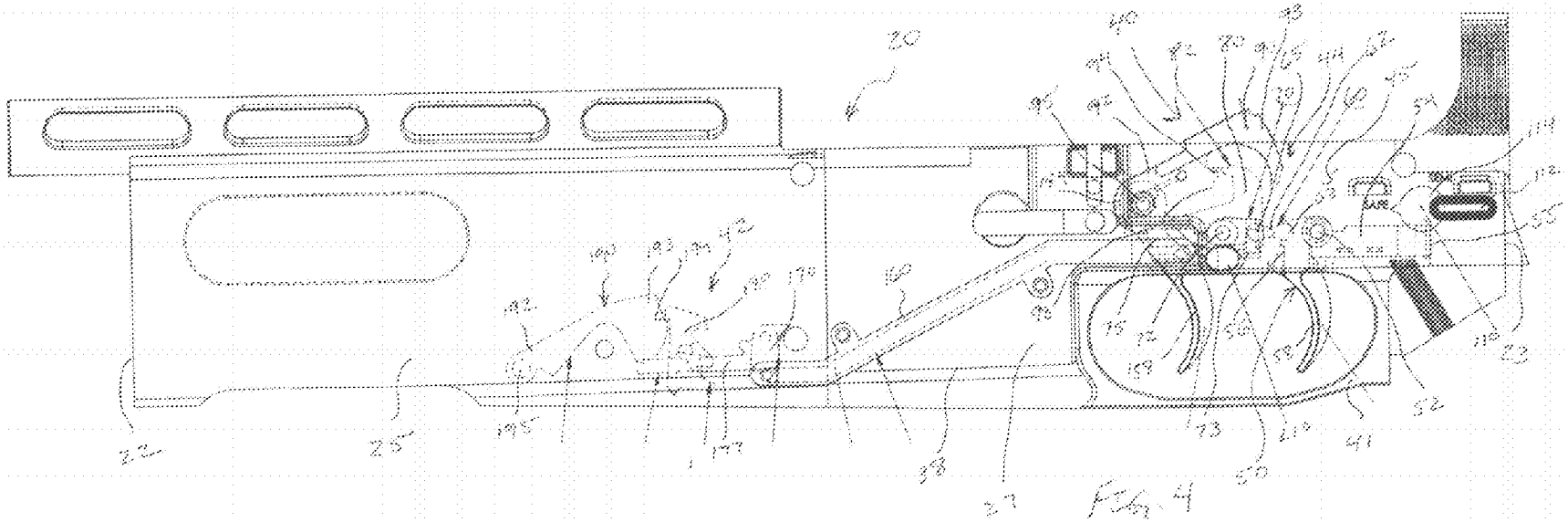
FIG. 4 is a side cut-away view of the receiver and trigger mechanism.

With additional reference to FIGS. 3 and 4, to permit the combination of shotgun assembly 12 and rifle assembly 14, firearm 10 includes a receiver 20 having a forward end 22 and a rearward end 23. Receiver 20, while preferably being formed as a single, one piece element, includes a shotgun receiver portion 25 adjacent forward end 22, and a lower receiver portion 27 extending rearwardly from shotgun receiver portion 25 and adjacent rearward end 23. A butt stock 29 is attached to rearward end 23. A shotgun barrel 30 and a shotgun magazine tube 32 are coupled to shotgun receiver portion 25 and extend forwardly from forward end 22. An upper receiver 35 is coupled to lower receiver portion 27 of receiver 20. It will be understood that bolts, bolt carriers and other mechanisms are present in shotgun assembly 12 and rifle assembly 14, but these are well known components, and will not be described herein. One of ordinary skill in the art will understand that shotgun receiver portion 25 acts in a manner substantially identical to a conventional shotgun receiver, and lower receiver portion 27 and upper receiver 35 act in a manner substantially identical to a conventional AR 15 type firearm. The differences are joining the receivers in a single unit as described, and other features which will be addressed presently. A rifle barrel 36 is coupled to and extends forwardly from upper receiver 35.

Referring specifically to FIGS. 3 and 4, receiver 20 includes a magazine well 38 for receiving a magazine 39 for rifle assembly 14. Magazine well 38 is configured to operate in a manner the same as a magazine well of a conventional AR-15 and is positioned on lower receiver portion 27 in a similar manner. A trigger mechanism 40 is carried by receiver 20. A trigger guard 41 is positioned underlying lower receiver portion 27 for housing the finger grip portions of trigger mechanism 40 for shotgun assembly 12 and rifle assembly 14 in an adjacent spaced apart manner, operable by the same finger of a user without additional hand adjustment. The components of shotgun assembly 12 and rifle assembly 14 are generally conventional components, as stated previously, with the exception of receiver 20 and trigger mechanism 40.

Figure 5:
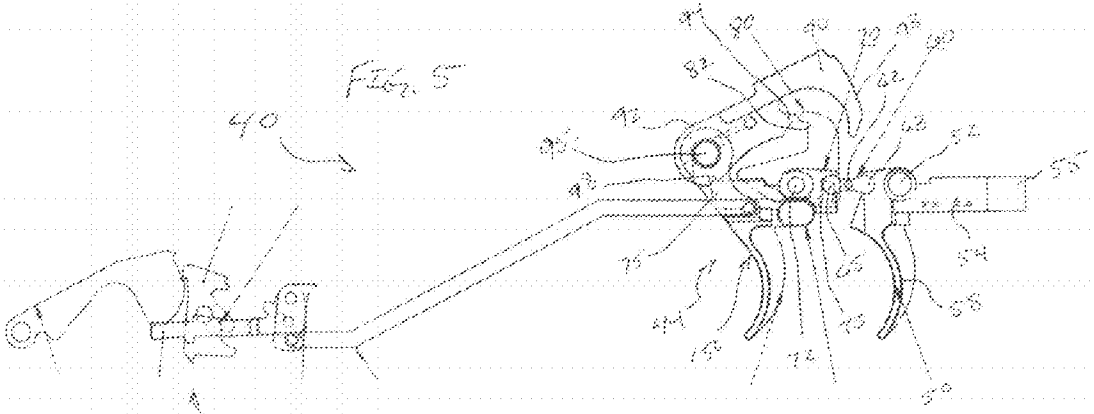
FIG. 5 is a side view of the trigger mechanism.
Figure 6:
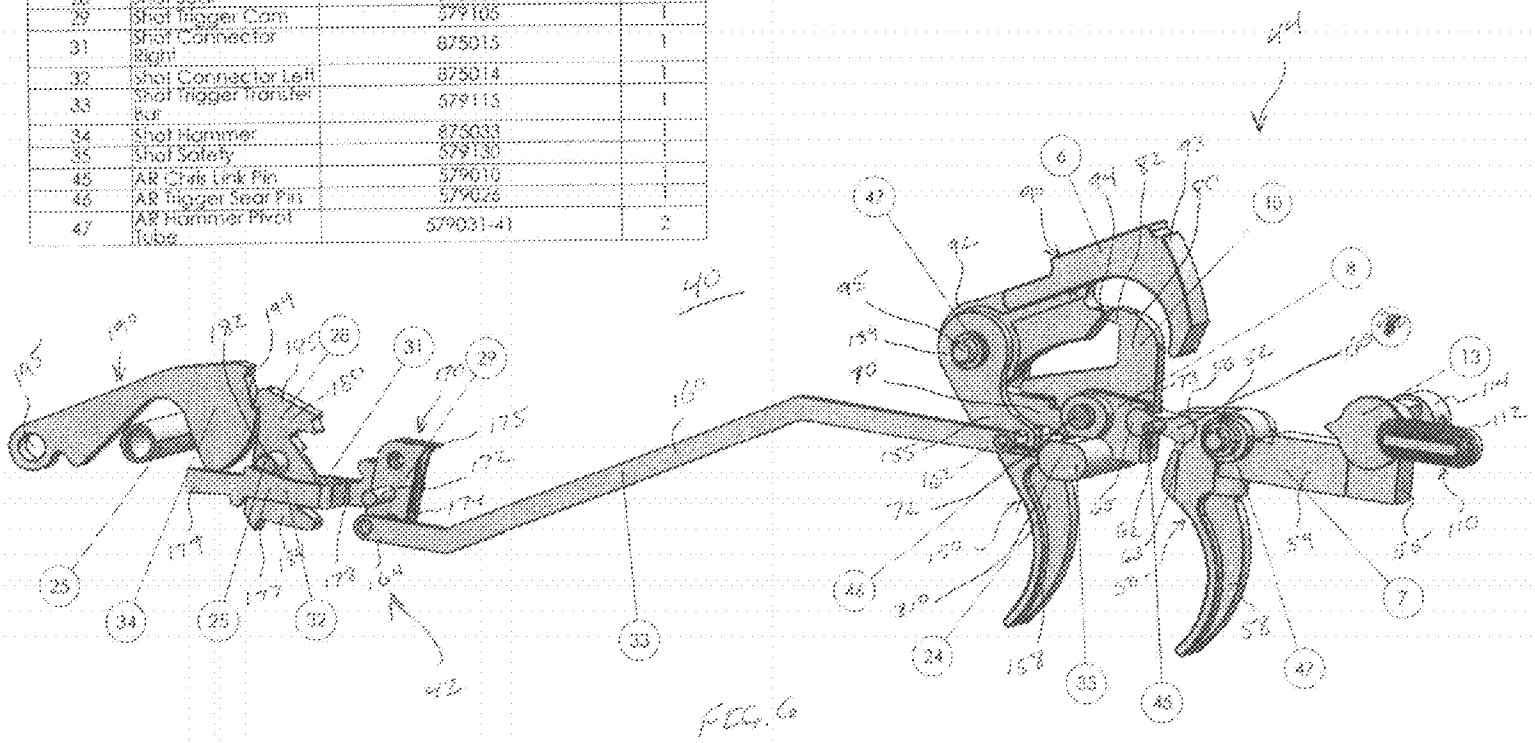
FIG. 6 is a perspective view of the trigger mechanism.

With additional reference to FIGS. 5 and 6, trigger mechanism 40 includes a shotgun trigger assembly 42 and a rifle trigger assembly 44. Rifle trigger assembly 44 is carried within a rifle trigger box 45 located in lower receiver portion 27, rearward of magazine well 38 and over trigger guard 41. Rifle trigger assembly 44 includes a trigger 50 pivotally mounted within rifle trigger box 45 on a transversely oriented pivot pin 52 and movable between a fire position and a cocked position. Trigger 50 has an elongated upper portion 54 having a rearward end 55 and a forward end 56, and a depending finger grip 58. Finger grip 58 is movable between a forward (cocked) position and a rearward (fire) position. A link member 60 is pivotally mounted within rifle trigger box 45 on a transversely oriented pivot pin 62 positioned intermediate a rearward end 63 and a forward end 65. Rearward end 63 is pivotally coupled to forward end 56 of trigger 50, and forward end 65 of link member 60 is pivotally coupled to a sear member 70. Sear member 70 is pivotally mounted within rifle trigger box 45 on a transversely oriented pivot pin 72. Sear member 70 is an elongated element having a rearward end 73 pivotally coupled to forward end 65 of link member 60, a forward end 75 and an elongated groove 77 formed longitudinally therein from rearward end 73 to forward end 75. Sear member 70 is movable between an engaged position and a disengaged position, as will be described presently.

Pivot pin 72 which mounts sear member 70, also serves to pivotally mount a disconnector 80 having a lower portion carried within groove 77 and a hook 82 formed in an upper portion. A compression spring is interposed between the bottom of groove 77 and the underside of disconnector 80 in order to urge disconnector 80 in a clockwise direction about pivot pin 72 so that hook 82 is movable between a forward (engaged) position and a rearward (disengaged) position. A hammer 90 includes a lower portion 92, an upper portion 93 and a disconnector abutment 94 extending rearwardly and intermediate lower portion 92 and upper portion 93. Hammer 90 is mounted for rotation about lower portion 92 on a pivot pin 95 between a forward (firing) position and a rearward (cocked) position. Hammer 90 is biased into the forward (firing) position by a torsion spring, and held in the rearward (cocked) position by engagement of sear member 70 with a sear abutment 98 formed on lower portion 92 of hammer 90. Sear member 70 engages sear abutment 98 when finger grip 58 is in the forward (cocked) position. It will be understood that during the firing cycle, disconnector 80 will engage disconnector abutment 94 briefly before the sear abutment 98 is engaged by sear member 70.

A rifle safety mechanism 110 is mounted in and upon receiver 20 and includes a control tab 112 mounted on the exterior of receiver 20 and a safety cam 114 extending transversely of the rifle trigger box 45 overlying rearward end 55 of elongated upper portion 54 of trigger 50. Safety cam 114 is movable between a safe configuration and a fire configuration by control tab 112. In order to fire rifle assembly 14, finger grip 58 must be moved from the forward (cocked) position to the rearward (fire) position. In doing so, rearward end 55 of elongated upper portion 54 of trigger 50 must be free to move upwardly. This upward movement is prevented by safety cam 114 when in the safe configuration and permitted when in the fire configuration. It will be understood by those skilled in the art that a selective fire mechanism can be provided as in the conventional firearms, to include semi-automatic, burst and full automatic modes or any combination thereof as in the conventional firearm prior to modification.

Still referring to FIGS. 4, 5, and 6, shotgun trigger assembly 42 includes a trigger 150, carried within rifle trigger box 45, and pivotally mounted within rifle trigger box 45 on transversely oriented pivot pin 95 and movable between a fire position and a cocked position. Trigger 150 has an upper portion 154 pivotally mounted on pivot pin 95, an intermediate portion 155 and a depending finger grip 158. Finger grip 158 is movable between a forward (cocked) position and a rearward (fire) position. A shotgun trigger transfer bar 160 has a rearward end 162 coupled to intermediate portion 155 of trigger 150 and extends forwardly to shotgun receiver portion 25, terminating in a forward end 164. A cam member 170 is pivotally mounted within a shotgun trigger box 168 on a transversely oriented pivot pin 172. Cam member 170 includes a lower portion 174 coupled to forward end 164 of shotgun trigger transfer bar 160 and an upper portion 175. Pivot pin 172 is mounted intermediate lower portion 174 and upper portion 175 so that cam member 170 is movable between a fire position and a cocked position. In the fire position, lower portion 174 is moved from a forward position to a rearward position, and upper portion 175 is moved from a rearward position to a forward position. The positions are reversed in the cocked position. An elongated connector member 177 includes a rearward end 178 coupled to upper portion 175 of cam member 170 and a forward end 179

A sear member 180 is pivotally mounted within shotgun trigger box 168 on a transversely oriented pivot pin 182. Sear member 180 includes a lower portion 184 coupled to forward end 179 of elongated connector member 177 and an upper portion 185. Pivot pin 182 is mounted intermediate lower portion 184 and upper portion 185 so as to be movable between a disengaged (fire) position and an engaged (cocked) position. To move sear member 180 from an engaged position to a disengaged position, lower portion 184 is moved from a rearward position to a forward position, and upper portion 185 is moved from a forward position to a rearward position.

A hammer 190 includes a lower portion 192, an upper portion 193 and a sear abutment 194 formed in upper portion 193 proximate an upper edge thereof. Hammer 190 is mounted for rotation about lower portion 192 on a pivot pin 195 between a forward (firing) position and a rearward (cocked) position. Hammer 190 is biased into the forward (firing) position by a torsion spring, and held in the rearward (cocked) position by engagement of sear member 180 with sear abutment 194. Sear member 180 engages sear abutment 194 when finger grip 158 is in the forward (cocked) position.

A shotgun safety mechanism 210 is mounted in and upon receiver 20 and includes a control tab 212 mounted on the exterior of receiver 20 and a safety cam 114 extending transversely of the rifle trigger box 45 positioned behind trigger 150 and underlying sear member 70 and pivot point 72. Safety mechanism 210 is movable between a safe position and a fire position. In the safe position, safety mechanism 210 prevents movement of trigger 150 to the rearward (fire) position.

As can be seen from the description and drawings, trigger 50 and trigger 150 for operating rifle assembly 14 and shotgun assembly 12, respectively, are both positioned so finger grips 58 and 158 both extend within trigger guard 41. In this manner, a standard firing grip for an AR-15 type firearm can be employed to fire both rifle assembly 14 and shotgun assembly 12 without requiring repositioning of the firing hand of an operator.

A conversion method is also provided whereby an existing AR-15 can be converted to the rifle/shotgun combination forearm 10 of the present invention by removing the lower receiver and trigger mechanism, and replacing them with receiver 20 and trigger mechanism 40 of the present invention. Parts for shotgun assembly 12 can be provided from existing shotguns, again by removing the existing receiver, trigger assembly and stock and adding the remaining parts to receiver 20.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A rifle/shotgun combination firearm comprising:

a shotgun receiver portion;

a lower receiver portion extending rearwardly from the shotgun receiver;

a rifle trigger assembly carried in the lower receiver portion and actuated by a rifle trigger coupled thereto, the rifle trigger having a finger grip extending below the lower receiver portion;

a shotgun trigger assembly carried by the shotgun receiver portion and actuated by a shotgun trigger pivotally carried on a transversely oriented pivot pin in the lower receiver portion, the shotgun trigger having a finger grip extending below the lower receiver portion forward of and adjacent to the rifle trigger;

a shotgun trigger transfer bar coupling the shotgun trigger assembly to the shotgun trigger; and wherein the rifle trigger assembly further includes a sear member pivotally mounted within the lower receiver for movement between an engaged position and a disengaged position, and a link member pivotally mounted within the lower receiver and pivotally coupled between the rifle trigger and the sear member, the link member displacing the rifle trigger rearwardly, so as to provide a space between the shotgun trigger and the rifle trigger.

2. A rifle/shotgun combination firearm as claimed in claim 1 wherein the shotgun trigger assembly further includes:

a cam member pivotally mounted within the shotgun receiver portion for movement between a fire position and a cocked position, the cam member coupled to the shotgun trigger transfer bar;

a sear member pivotally mounted within the shotgun receiver portion and movable between a disengaged position and an engaged position; and an elongated connector member coupled between the cam member and the sear member.

3. A rifle/shotgun combination firearm as claimed in claim 2 further comprising a shotgun hammer mounted in the shotgun receiver portion for rotation between a forward position and a rearward position, the hammer biased into the forward position by a torsion spring, and held in the rearward position by engagement of the sear member.

4. A rifle/shotgun combination firearm as claimed in claim 1 further including a rifle hammer mounted on the transversely oriented pivot pin in the lower receiver portion for rotation between a forward position and a rearward position.

5. A rifle/shotgun combination firearm as claimed in claim 1 wherein the receiver is formed as a single piece.

* * * * *